US008839983B2

(12) United States Patent
Chiou et al.

(10) Patent No.: US 8,839,983 B2
(45) Date of Patent: Sep. 23, 2014

(54) BOTTOM PAD FOR BEVERAGE CONTAINER

(75) Inventors: Joe Y. Chiou, Wilmette, IL (US); Sami M. El-Saden, Winnetka, IL (US)

(73) Assignee: Ignite USA, LLC, Chicago, IL (US)

( * ) Notice: Subject to any disclaimer, the term of this patent is extended or adjusted under 35 U.S.C. 154(b) by 305 days.

(21) Appl. No.: 13/188,119

(22) Filed: Jul. 21, 2011

(65) Prior Publication Data

US 2013/0020334 A1 Jan. 24, 2013

(51) Int. Cl.
*B65D 25/00* (2006.01)
*B65D 25/24* (2006.01)
*B65D 23/00* (2006.01)

(52) U.S. Cl.
CPC ..... *B65D 25/24* (2013.01); *B65D 23/001* (2013.01)
USPC ..... 220/636; 220/626; 220/630; 220/729

(58) Field of Classification Search
USPC ..... 220/636, 626, 628, 630, 632, 729
See application file for complete search history.

(56) References Cited

U.S. PATENT DOCUMENTS

| | | | | |
|---|---|---|---|---|
| 4,591,066 | A | 5/1986 | Moen | |
| 4,685,577 | A | 8/1987 | Chen | |
| 5,056,749 | A * | 10/1991 | Ige | 248/346.11 |
| 5,285,996 | A | 2/1994 | Waller | |
| 5,312,013 | A | 5/1994 | Bridges | |
| 5,456,380 | A | 10/1995 | Ito et al. | |
| 5,465,891 | A | 11/1995 | Bridges | |
| 5,918,761 | A | 7/1999 | Wissinger | |
| 6,142,325 | A | 11/2000 | Chomik | |
| 6,152,018 | A * | 11/2000 | Yeh | 99/279 |
| 6,439,418 | B1 | 8/2002 | Immerman et al. | |
| 6,491,183 | B1 * | 12/2002 | Huang | 220/629 |
| 6,662,963 | B1 * | 12/2003 | Meike et al. | 220/634 |
| 6,764,622 | B2 | 7/2004 | Moran | |
| 6,796,430 | B2 * | 9/2004 | Mercier et al. | 206/505 |
| 7,370,770 | B2 | 5/2008 | Chomik | |
| 8,025,169 | B2 * | 9/2011 | Zimmerman | 220/23.89 |
| 8,028,850 | B2 * | 10/2011 | Zimmerman | 220/23.89 |
| 2002/0130133 | A1 * | 9/2002 | Immerman et al. | 220/630 |
| 2003/0209563 | A1 | 11/2003 | Lin et al. | |
| 2004/0016761 | A1 * | 1/2004 | Wilde et al. | 220/630 |
| 2007/0101868 | A1 | 5/2007 | Porter | |
| 2011/0049167 | A1 * | 3/2011 | Martin et al. | 220/630 |

* cited by examiner

*Primary Examiner* — Mickey Yu
*Assistant Examiner* — Niki Eloshway
(74) *Attorney, Agent, or Firm* — McDermott Will & Emery LLP

(57) ABSTRACT

The present invention is directed a beverage container having a two-part base. The beverage container has a container body having a side wall member and a bottom member, and a liquid retaining cavity therebetween. The container body has a first mating member adjacent a bottom of the container body. The two-part base comprises an inner member partially surrounded by an outer member, and wherein the inner member is preferably made of a rigid material and wherein the outer member is preferably made of a thermoplastic elastomer. The two-part base has a second mating member, whereby the two-part base is connected to the container body adjacent the bottom of the container body via a mating connection between the first mating member and the second mating member. Portions of the two-part base contact the bottom member of the container body to define seal areas that create a substantially fluid-tight seal between the base and the container body, thereby allowing the beverage container to be top-shelf dishwasher safe.

19 Claims, 4 Drawing Sheets

BOTTOM PAD FOR BEVERAGE CONTAINER

CROSS-REFERENCE TO RELATED APPLICATIONS

Not Applicable

FEDERALLY SPONSORED RESEARCH OR DEVELOPMENT

Not Applicable.

TECHNICAL FIELD

The present invention relates generally to a beverage container, and more specifically to a two part bottom pad for a beverage container.

BACKGROUND OF THE INVENTION

Beverage containers and bottom pads for beverage containers are well known in the art. Traditionally, bottom pads are comprised of a single component, made of a rubber or plastic material. Such pads are joined to the bottom of the beverage container. In such a configuration, a relatively large space volume is located between the pad and the bottom of the container body. While such containers and bottom pads according to the prior art provide a number of advantages, they nevertheless have certain limitations. For example, water and other liquids can seep into this area, especially when the container is subject to hot water under high pressure, such as in the dishwasher. For this reason, among others, most beverage containers with a bottom pad are not dishwasher safe. The present invention seeks to overcome certain of these limitations and other drawbacks of the prior art, and to provide new features not heretofore available. A full discussion of the features and advantages of the present invention is deferred to the following detailed description, which proceeds with reference to the accompanying drawings.

SUMMARY OF THE INVENTION

The present invention generally provides a beverage container comprising a container body and a base. In one embodiment the container body has a side wall member and a bottom member, and a liquid retaining cavity therebetween.

According to another embodiment, the container body also has a first mating member adjacent a bottom of the container body.

According to another embodiment, the base comprises a generally rigid inner member and an outer member. The inner member has a second mating member that mates with the first mating member of the container body.

According to another embodiment, the inner member has an exterior surface, an interior surface, a first edge, and a second edge. The second mating member is located on the interior surface of the inner member and is adapted to engage the first mating member on the beverage container to fix the inner member to the beverage container. In one embodiment the inner member is made of a polypropylene plastic material.

According to another embodiment, the outer member comprises a thermoplastic elastomer at least partially surrounding and permanently secured to the exterior surface of the inner member.

According to another embodiment, a first seal area and a second seal area are created between the base and the container body. In one embodiment, the outer member has a top end that extends beyond the first edge of the inner member and that is adapted to engage the beverage container to create a first seal area between the base and the beverage container, and the outer member having a bottom end that extends beyond the second edge of the inner member and that is adapted to engage the beverage container to create a second seal area between the base and the beverage container, wherein the second mating member is positioned between the first seal area and the second seal area when the base is connected to the beverage container, and wherein the first seal area and the second seal area create a substantially fluid tight seal between the base and the beverage container.

Other features and advantages of the invention will be apparent from the following specification taken in conjunction with the following drawings.

BRIEF DESCRIPTION OF THE DRAWINGS

To understand the present invention, it will now be described by way of example only, not by way of limitation, with reference to the accompanying drawings in which.

DETAILED DESCRIPTION

Figure 1:
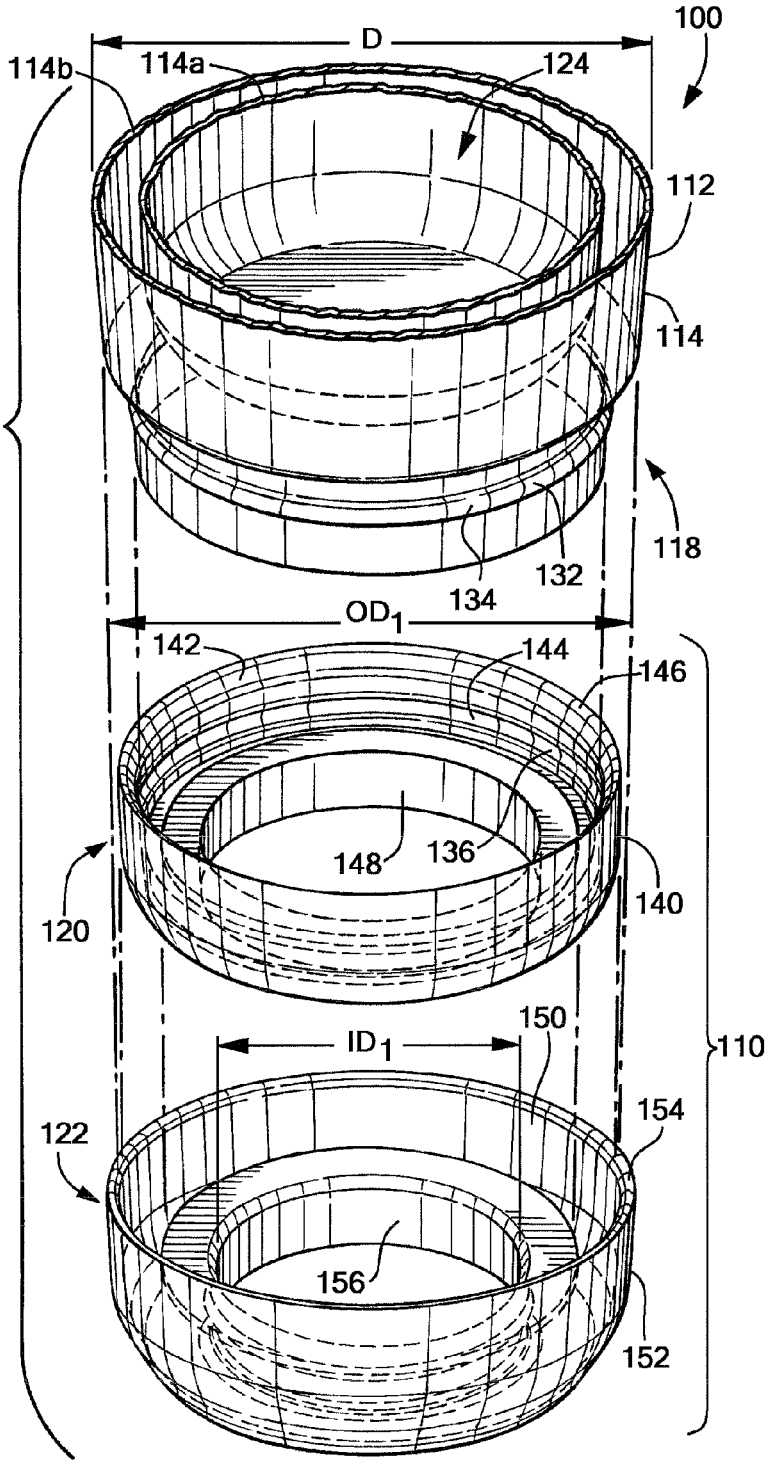
FIG. 1 is an exploded perspective view of one example of a bottom pad for a beverage container.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring now to the figures, and specifically to FIG. 1, there is shown a beverage container 100 having a base or bottom pad 110. The beverage container 100 generally comprises a container body 112 having a side wall member 114, a bottom member 116 toward a distal end 118 of the side wall member 114, and a liquid retaining cavity 124 therebetween. Further, the base 110 generally comprises a two-part construction of an inner member 120 and an outer member 122. In one embodiment the base 110 is also referred to as a snap-ring 110 because of its ring-like geometry/construction.

As shown in FIG. 1, in one embodiment the container body 112, and specifically the side wall member 114 of the container body 112 is generally cylindrical and has an outer diameter D. Similarly, the base or bottom pad 110 is also generally circular or cylindrical in this embodiment. However, it is understood that the container body 112 may have a different geometry other than being cylindrical. For example, the container body 112 may have a horizontal cross section geometry that is elliptical, rectangular, square, etc. Similarly, the base 112 may have a different cross section other than circular, such as elliptical, rectangular, square, etc. Further, the cross-sectional geometry of the base 112 may not be the same as the cross-sectional geometry of the container 112 in additional embodiments.

The container body 112 may have a dual wall construction, such that the side wall member 114 comprises an inner side wall 114*a* and an outer side wall 114*b*. The dual wall construction allows for insulation, either a physical insulation such as foam or a vacuum cavity insulation between the inner side wall 114*a* and the outer side wall 114*b*.

Figure 2:
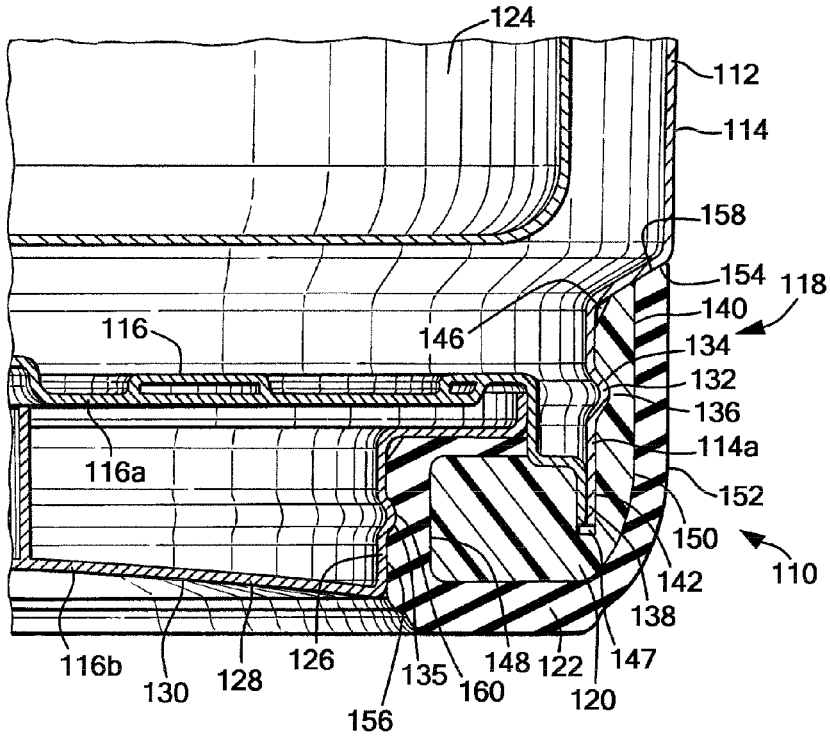
FIG. 2 is a partial cross-sectional view of one example of a bottom pad for a beverage container.
Figure 3:
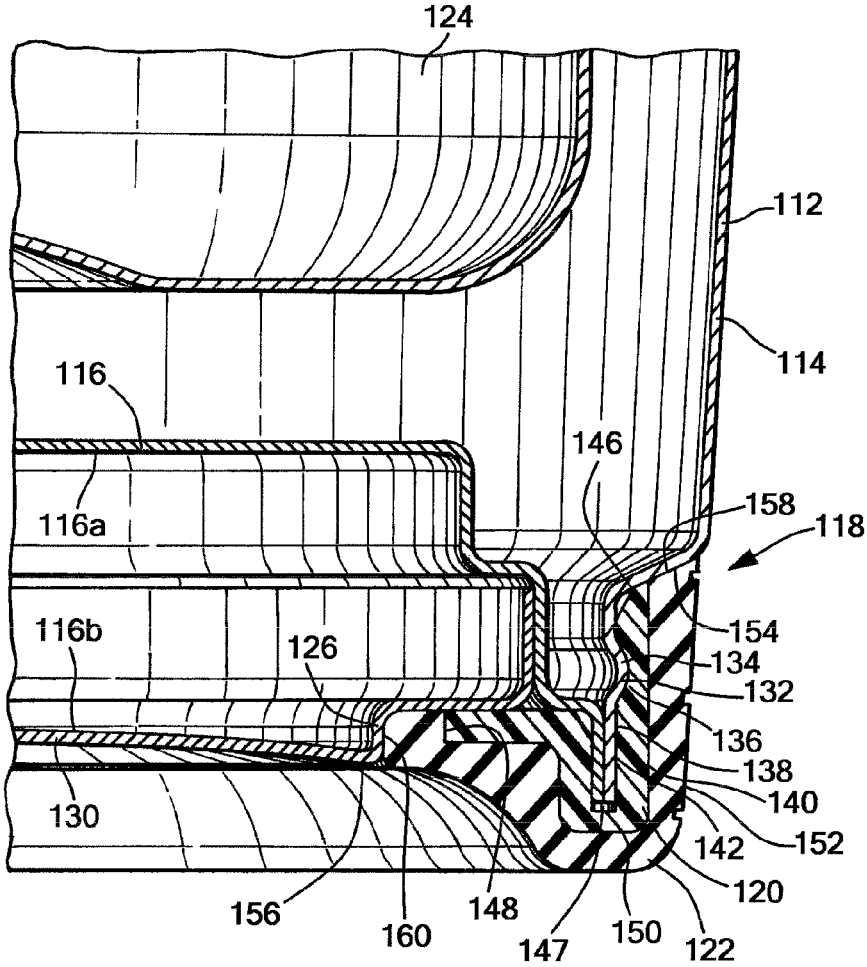
FIG. 3 is a partial cross-sectional view of one example of another bottom pad for a beverage container.

In one embodiment the bottom member 116 is generally connected to a portion of the side wall member 114 adjacent a distal end 118 of the side wall member 114. Like the side wall member 114, the bottom member 116 may have a multiple component construction. For example, as shown in FIGS. 2 and 3, the bottom member 116 comprises an inner bottom member 116*a* and an outer bottom member 116*b*. In this embodiment the inner bottom member 116*a* is secured to the outer side wall 114*b*, preferably via welding, however one of ordinary skill in the art would readily understand that alternate securement means are available. The outer bottom member 116*b* is similarly secured, via welding or other means, to the inner bottom member 116*a*. In one embodiment, the bottom member 116 has a lateral portion 126 and a radial portion 128 which assists in defining a central hub 130 of the bottom member 116.

Figure 4:
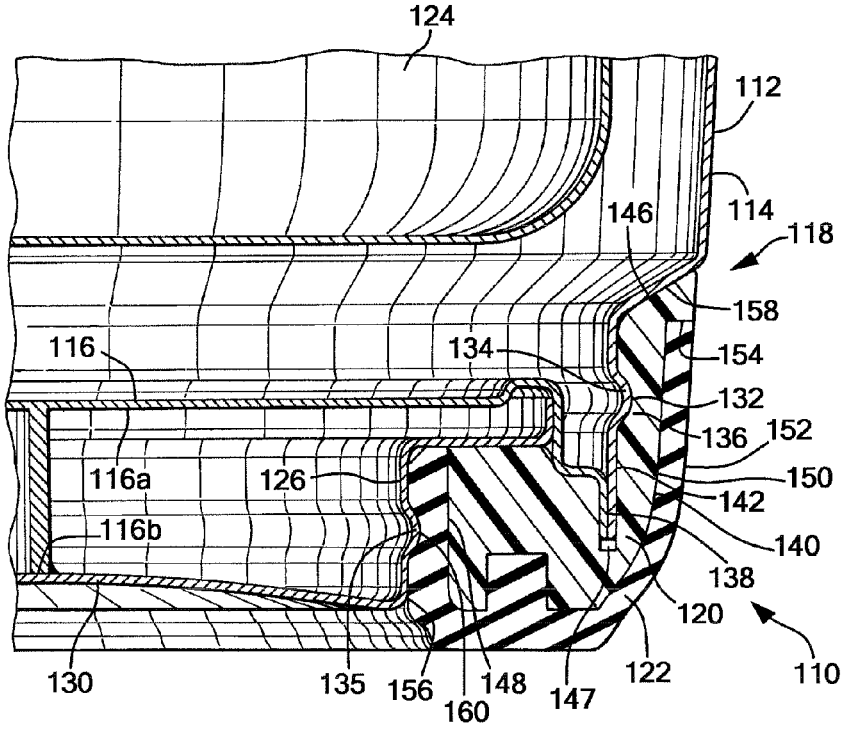
FIG. 4 is a partial cross-sectional view of one example of another bottom pad for a beverage container.

As shown in FIGS. 1-4, a first mating member 132 is provided on the container body 112 adjacent a bottom of the container body 132. As explained in detail herein, the first mating member 132 of the container body 112 mates with a second mating member 136 of the base 110. In one embodiment the first mating member 132 is a protrusion 134, and preferably an annular protrusion 134 when the container body 112 is cylindrical in shape. Additionally, the first mating member may be a rib 134. In alternate embodiments the first mating member 132 may be a detent (not shown), threads for a rotational fixation (not shown) or any number of alternate means to secure the base 110 to the container body 112. Referring to FIGS. 2 and 4, in one embodiment another mating member, such as a rib 135, is provided on the lateral portion 126 of the central hub 130 of the bottom member 116 to mate with the base 110 to secure the base 110 to the container body 112 and/or to provide another seal area, such as a second seal area, between the base 110 and the container body 112.

In one embodiment, as shown in FIGS. 2-4, the container body 112 also has an annular flange 138. In such an embodiment, the annular flange 138 may comprise an extension of the side wall member 114, and particularly the outer side wall member 114*b* as shown in FIGS. 2 and 3. Additionally, a portion of the bottom member 116 that is joined to the side wall member 114 may also be a component of the annular flange 138.

Referring now to FIGS. 1-4, the base 110, or snap-ring 110 as it is referred to in certain geometrical constructions, generally comprises a two-part construction of an inner member or inner ring 120 and an outer member or outer ring 122. In the embodiment where the base 110 is generally circular in cross-section, the base 110 has an outer diameter $OD_1$ that is generally equal to the outer diameter D of the container body 112. In alternate geometries, the outer circumference of the base 110 is preferably equal to the outer circumference of the container body 112. Further, in the embodiment wherein the base 110 has a ring-like geometry, the base 110 also has an inner diameter $ID_1$. In the embodiment wherein the base 110 has a ring-like geometry, the base 110 has a central opening radially inward of the inner diameter $ID_1$ to assist in defining the ring-like structure of the base 110.

In one embodiment the inner member 120 is a generally rigid member, and is preferably made of a plastic material such as a polypropylene. The inner member 120 has a second mating member 136 that engages and mates with the first mating member 132 of the container body 112 to secure the base 110 to the container body 112. According to one embodiment, a portion of the inner member 120 has an exterior wall or surface 140 and a portion of the inner member 120 has an interior wall or surface 142. Generally, the interior surface 142 of the inner member 120 faces toward the container body 112 when the base 110 is joined to the container body 112, and the outer surface 144 faces away from the container body 112 when the base 110 is joined to the container body 112. Additionally, in one embodiment the inner member 120 has a first edge 146 and a second edge 148. As shown in FIG. 2, in one embodiment the first edge 146 of the inner member joins the exterior wall 140 and the interior wall 142. In one embodiment the second edge 148 is generally at a portion of the inner member 120 opposite the first edge 146. Additionally, as shown in FIGS. 2-4, in one embodiment the inner member 120 has a channel 147 that receives the annular flange 138 of the container body 112.

In one embodiment the second mating member 136 of the base 110 is located on the interior wall 142 of the inner member 120 of the base 110. The second mating member 136 may be a detent 144 to receive the protrusion 134 of the first mating member 132 to fix the inner member 120 of the base 110 to the container body 112. Additionally, the second mating member 136 may be an annular detent 144 to receive an annular protrusion 134 on the container body 112 to secure the base 110 to the container body 112. Further, the second mating member 136 may mate with a rib 134 operating as the first mating member 132 of the container body 112. Conversely, the first mating member 132 may be a detent or other receiver, and the second mating member 136 may be a protrusion, rib or other component that mates with the first mating member 132. Additionally, in alternate embodiments the second mating member 136 may be a threads for a rotational fixation (not shown) or any number of alternate means to secure the base 110 to the container body 112.

As explained above, the base 110 preferably comprises an inner member 120 and an outer member 122. In one embodiment the outer member 122 is a flexible member at least partially surrounding and secured, preferably permanently, to the outer surface 140 of the inner member 120. The outer member 122 generally comprises the bottom most surface of the overall beverage container 100. In one embodiment the outer member 122 is made of a thermoplastic elastomer material. Additionally, in a preferred embodiment the outer member 122 is molded to the inner member 120, and in a most preferred embodiment the outer member 122 surrounds the inner member 120 such that the inner member 120 is completely enclosed between the container body 112 and the outer ring member 122 following final assembly. Preferably, the outer member 122 has an interior surface 150 and an exterior surface 152. In one embodiment a portion of the interior surface 150 of the outer member 122 engages a portion of the exterior surface 142 of the inner member 120. As shown in FIGS. 2 and 3, in one embodiment outer member 122 has a top end 154 that joins the interior surface 150 of the outer member 122 to the exterior surface 152 of the outer member 122. Additionally, the outer member 122 has a bottom end 156 opposing the top end 154. In a preferred embodiment the outer member 122 has a ring-like structure, as shown in FIG. 1, with an overall outer diameter and an overall inner diameter.

Referring to FIG. 1, in one embodiment the base 110 comprises a snap ring 110 made of the inner ring 120 partially surrounded by the outer ring 122. As shown in FIGS. 2 and 3, in one embodiment a first portion of the snap ring 110, and preferably the outer member 122, contacts the container body 112 at a first location to create a first seal area 158 between the base 110 and the container body 112. In various embodiments the top end 154 of the outer ring 122 extends beyond the first edge 146 of the inner ring 120 and is adapted to engage the beverage container 112 to create the first seal area 158 between the base 110 and the container body 112. Similarly, in one embodiment a second portion of the snap ring 110, and preferably the outer member 122, contacts the container body 112 at a second location, such as the central hub or a lateral surface of the container body 112, to create a second seal area 160 between the base 110 and the container body 112. In various embodiments the bottom end 156 of the outer ring 122 extends beyond the second edge 148 of the inner ring member 120 and is adapted to engage the beverage container 112 to create the second seal area 160 between the base 110 and the container body 112. The first seal area 158 and the second seal area 160 preferably create a substantially fluid tight seal between the base 110 and the container body 112 to substantially prevent fluid from entering a region between the base 110 and the container body 112, thereby allowing the beverage container to be categorized as top-shelf dishwasher safe.

In an alternate embodiment, shown in FIG. 4, the top end 154 of the outer member 122 does not extend beyond the first edge of the 146 of the inner ring 120. To the contrary, the first edge 146 of the inner ring 120 extends beyond the top end 154 of the outer member 122, and the first edge 146 of the inner ring 120 engages the container body 112 of the beverage container 10. A first seal area 158 is thus created between the inner member 120 of the base 110 and the container body 112. However, in this embodiment of FIG. 4, the second seal area 160 is still maintained between the outer member 122 and the rib 135 on the central hub 130 of the bottom member 116.

Several alternative examples have been described and illustrated herein. A person of ordinary skill in the art would appreciate the features of the individual embodiments, and the possible combinations and variations of the components. A person of ordinary skill in the art would further appreciate that any of the examples could be provided in any combination with the other examples disclosed herein. Additionally, the terms "first," "second," "third," and "fourth" as used herein are intended for illustrative purposes only and do not limit the embodiments in any way. Further, the term "plurality" as used herein indicates any number greater than one, either disjunctively or conjunctively, as necessary, up to an infinite number. Additionally, the word "including" as used herein is utilized in an open-ended manner.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

What is claimed is:

1. A beverage container comprising:

a container body having a side wall member and a bottom member, and a liquid retaining cavity therebetween, the container body having a first mating member adjacent a bottom of the container body; and, a snap-ring having a second mating member, the snap-ring connected to the container body adjacent the bottom of the container body via a mating connection between the first mating member and the second mating member, wherein the first mating member comprises one of a detent and a protrusion, wherein the second mating member comprises the other of the detent and the protrusion, wherein the snap-ring comprises an inner ring partially surrounded by an outer ring, and wherein the inner ring is made of a rigid material and wherein the outer ring is made of a thermoplastic elastomer, the thermoplastic elastomer of the snap ring abutting an exterior surface of the container body to define a first seal area, and a second portion of the snap-ring contacting the bottom member of the container body to define a second seal area, the first and second seal areas creating a substantially fluid-tight seal between the snap-ring and the container body.

2. The beverage container of claim 1, wherein the snap-ring has an outer diameter substantially equal to an outer diameter of the container body, an inner diameter, and a central opening interior of the inner diameter to define a ring-like structure.

3. The beverage container of claim 1, wherein the second seal area is defined by the thermoplastic elastomer of the snap-ring abutting a lateral surface of the container body.

4. The beverage container of claim 1, wherein the first mating member of the container body comprises an annular protrusion extending from the container body.

5. The beverage container of claim 4, wherein the annular protrusion is a rib.

6. The beverage container of claim 4, wherein the second mating member of the snap-ring comprises an annular detent that receives the annular protrusion of the container body to secure the snap-ring to the container body.

7. The beverage container of claim 1, wherein the second mating member is located on the inner ring of the snap-ring.

8. The beverage container of claim 7, wherein the second mating member is located on an interior wall of the inner ring of the snap-ring.

9. The beverage container of claim 1, wherein the inner ring is made of polypropylene.

10. The beverage container of claim 1, wherein the bottom member has central hub that engages the outer ring of the snap-ring.

11. The beverage container of claim 10, wherein the central hub has a rib extending therefrom, the rib engaging a detent in an interior wall of the outer ring of the snap-ring.

12. A beverage container comprising:

a container body having a side wall member and a bottom member, and a liquid retaining cavity therebetween, the container body having a first rib extending from the container body adjacent a bottom of the container body; and, a base comprising a generally rigid inner ring member and a flexible outer ring member; the inner ring member having an exterior surface, an interior surface, a first edge, a second edge, and a detent, the detent positioned on the interior surface of the inner ring member and adapted to engage the first rib extending from the beverage container to fix the inner ring member to the beverage container, the flexible outer ring member at least partially surrounding and secured to the outer surface of the inner ring member, the outer ring member having a top end that extends beyond the first edge of the inner ring member and that is adapted to engage the beverage container to create a first seal area between the base and the beverage container, and the outer ring member having a bottom end that extends beyond the second edge of the inner ring member and that is adapted to engage the beverage container to create a second seal area between the base and the beverage container, the base having an overall outer diameter that is generally equal to an outer diameter of the beverage container, an inner diameter, and a central opening interior of the inner diameter to define a ring-like structure, wherein the detent is positioned between the first seal area and the second seal area when the base is connected to the beverage container, and wherein the first seal area and the second seal area create a substantially fluid tight seal between the base and the beverage container.

13. The beverage container of claim 12, further comprising a second rib extending from the container body to engage the outer surface of the outer ring member.

14. The beverage container of claim 12, wherein the inner ring member is made of a polypropylene plastic and the outer ring member is made of a flexible thermoplastic elastomer.

15. The beverage container of claim 12, further comprising a channel in the inner ring member, the channel receiving an annular flange extending from the beverage container.

16. The beverage container of claim 12, wherein the outer ring member is the bottom surface for the beverage container.

17. The beverage container of claim 12, wherein the outer ring member surrounds the inner ring member such that the inner ring member is completely enclosed between the beverage container and the outer ring member.

18. A beverage container comprising:

a container body having a side wall member and a bottom member, and a liquid retaining cavity therebetween, the container body having a first mating member adjacent a bottom of the container body; and, a base comprising a generally rigid inner member and an outer member, the inner member having an exterior surface, an interior surface, a first edge, a second edge, and a second mating member located on the interior surface of the inner ring member and adapted to engage the first mating member on the beverage container to fix the inner member to the beverage container, the outer member comprising a thermoplastic elastomer at least partially surrounding and permanently secured to the exterior surface of the inner member, the outer member having a top end that extends beyond the first edge of the inner member and that is adapted to engage the beverage container to create a first seal area between the base and the beverage container, and the outer member having a bottom end that extends beyond the second edge of the inner member and that is adapted to engage the beverage container to create a second seal area between the base and the beverage container, wherein the second mating member is positioned between the first seal area and the second seal area when the base is connected to the beverage container, and wherein the first seal area and the second seal area create a substantially fluid tight seal between the base and the beverage container.

19. The beverage container of claim 18, wherein the base has an outer diameter substantially equal to an outer diameter of the container body, an inner diameter, and a central opening interior of the inner diameter to define a ring-like structure.

* * * * *